US005886324A

United States Patent [19]

Shea

[11] Patent Number: 5,886,324

[45] Date of Patent: Mar. 23, 1999

[54] ELECTRODE ATTACHMENT FOR HIGH POWER CURRENT LIMITING POLYMER DEVICES

[75] Inventor: John Joseph Shea, Pittsburgh, Pa.

[73] Assignee: Eaton Corporation, Cleveland, Ohio

[21] Appl. No.: 850,465

[22] Filed: May 5, 1997

Related U.S. Application Data

[63] Continuation-in-part of Ser. No. 770,746, Dec. 19, 1996.

[51] Int. Cl.[6] ..... H05B 1/02

[52] U.S. Cl. ..... 219/505; 219/541; 219/536; 338/22 R; 29/611

[58] Field of Search ..... 219/504, 505, 219/553, 541, 542, 543; 338/22 R, 225 D; 252/502; 428/195, 560, 546, 548, 550, 551, 553–558; 29/611; 264/105, 131, 134

[56] References Cited

U.S. PATENT DOCUMENTS

| | | | |
|---|---|---|---|
| 3,351,882 | 11/1967 | Kohler et al. | 338/332 |
| 3,858,144 | 12/1974 | Bedard et al. | 219/553 |
| 4,272,471 | 6/1981 | Walker | 264/104 |
| 4,304,987 | 12/1981 | van Konynenburg | 219/553 |
| 4,314,231 | 2/1982 | Walty | 338/328 |
| 4,330,703 | 5/1982 | Horsma et al. | 219/553 |
| 4,426,633 | 1/1984 | Taylor | 338/25 |
| 4,444,708 | 4/1984 | Gale et al. | 29/105 |
| 4,475,138 | 10/1984 | Middleman et al. | 361/58 |
| 4,485,838 | 12/1984 | Jacobs et al. | 29/671 |
| 4,545,926 | 10/1985 | Fouts, Jr. et al. | 252/511 |
| 4,647,894 | 3/1987 | Ratell | 338/22 R |
| 4,685,025 | 8/1987 | Carlomagno | 361/106 |
| 4,689,475 | 8/1987 | Kleiner et al. | 219/553 |
| 4,724,417 | 2/1988 | Au et al. | 338/22 R |
| 4,774,024 | 9/1988 | Deep et al. | 252/511 |
| 4,775,778 | 10/1988 | van Konynenburg et al. | 219/549 |
| 4,780,598 | 10/1988 | Fahey et al. | 219/511 |
| 4,800,253 | 1/1989 | Kleiner et al. | 219/553 |

(List continued on next page.)

OTHER PUBLICATIONS

ABB Control, *Installation and Maintenance of Current Limiting type PROLIM* Oct. 23, 1992.

*Surface Modification of Extended Chain Polyethylene Fibres to Improve Adhesion to Epoxy and Unsaturated Polyester Resins,* Oct. 23, 1990.

*E.S.C.A. Studies of Corona–Discharge–Treated Polyethylene Surfaces by Use of Gas–Phase Derivatization,* Polymer, vol. 26, No. 8, pp. 1162–1166, Aug. 1985.

*Constriction Resistance and the Real Area of Contact,* British Journal of Applied Physics pp. 1621–1632, (1966).

Asea Brown Boveri, ABB Control Product Brochure *There Are Lots Of Novelties And Sensations, But Only A Few Innovations.*

Asea Brown Boveri, ABB Control Product Brochure *Motor Starter Protection With PROLIM—The Complete Solution.*

(List continued on next page.)

*Primary Examiner*—Mark H. Paschall
*Attorney, Agent, or Firm*—Martin J. Moran

[57] ABSTRACT

A novel current limiting PTC polymer device and methods of making the same comprising a current limiting polymer composition with porous electrodes interfaced therewith such that a low contact resistance results using a combination of (1) extrusion attachment of the current limiting polymer composition to the porous electrodes, (2) careful selection of the electrode materials in view of the conductive filler and/or conductive metal particles in the current limiting polymer composition, and (3) plasma treatment of the attachment surfaces of the current limiting polymer composition preceding and/or during the extrusion attachment process. The invention provides for the selective treatment of portions of the surface of the current limiting polymer composition by at least one of plasma etching and metallizing to create attachment surfaces for extrusion attachment of porous electrodes resulting in a low contact resistance, mechanical stability and a reduced potential for arcing in the electrode/polymer interface. The electrical devices of the invention are particularly useful in circuit protection applications.

32 Claims, 2 Drawing Sheets

U.S. PATENT DOCUMENTS

Figure 1:
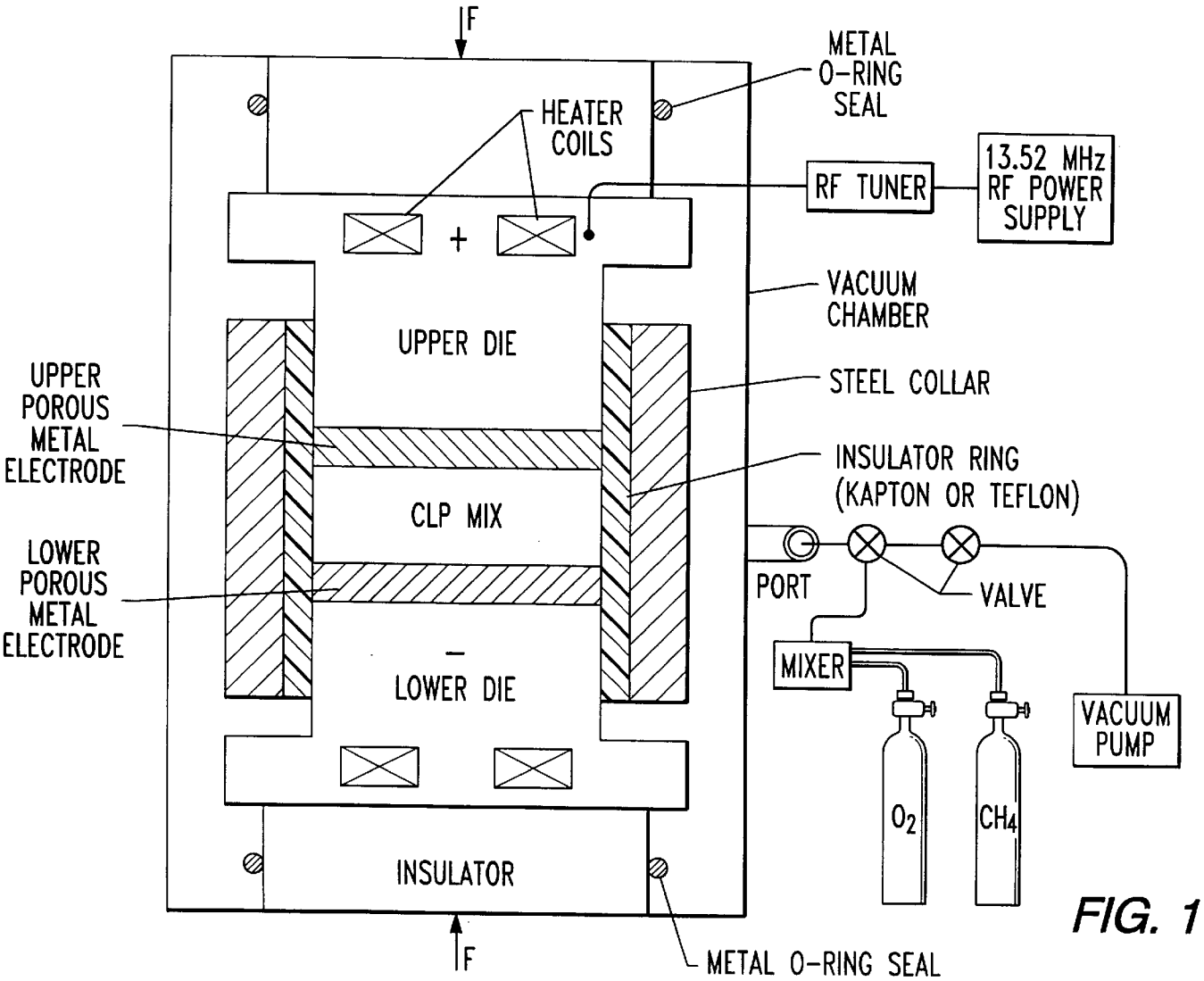

| | | | |
|---|---|---|---|
| 4,857,880 | 8/1989 | Au et al. . | |
| 4,907,340 | 3/1990 | Fang et al. | 29/610.1 |
| 4,910,389 | 3/1990 | Sherman et al. | 219/548 |
| 4,924,074 | 5/1990 | Fang et al. | 219/548 |
| 5,049,850 | 9/1991 | Evans | 338/22 R |
| 5,187,002 | 2/1993 | Egashira et al. | 428/195 |
| 5,195,013 | 3/1993 | Jacobs et al. | 361/106 |
| 5,358,793 | 10/1994 | Hanada et al. | 428/560 |
| 5,436,609 | 7/1995 | Chan et al. | 338/22 R |

OTHER PUBLICATIONS

RAYCHEM "Polyswitch"® Devices Standard Product List.

Asea Brown Boveri, ABB Control Product Brochure *New Current Limiter*.

ELECTRODE ATTACHMENT FOR HIGH POWER CURRENT LIMITING POLYMER DEVICES

1. CROSS-REFERENCE TO RELATED APPLICATIONS

This application is a continuation-in-part of U.S. patent application Ser. No. 08/770,746 filed on Dec. 19, 1996 pending.

2. FIELD OF THE INVENTION

This invention relates to electrical devices based on current limiting PTC polymer devices, and in particular to electrical circuit protection devices comprising a current limiting PTC polymer device composed of a current limiting polymer composition in combination with suitable electrodes. The invention also concerns the physical and electrical interface between the current limiting polymer composition and the electrodes combined thereto. Specifically, the invention concerns an interface between a current limiting polymer composition and a porous electrode resulting in a low contact resistance, mechanical stability and a reduced potential for arcing in the electrode/polymer interface.

3. BACKGROUND OF THE INVENTION

Current limiting polymer compositions which exhibit positive temperature coefficient of resistance (PTC) behavior, and electrical devices comprising current limiting polymer compositions have been widely used. The current limiting polymer compositions generally include conductive particles, such as carbon black, graphite or metal particles, dispersed in a polymer matrix, such as thermoplastic polymer, elastomeric polymer or thermosetting polymer. PTC behavior in a current limiting polymer composition is characterized by the material undergoing a sharp increase in resistivity as its temperature rises above a particular value otherwise known as the anomaly or switching temperature, $T_s$. Materials exhibiting PTC behavior are useful in a number of applications including electrical circuit protection devices in which the current passing through a circuit is controlled by the temperature of a PTC element forming part of that circuit.

Particularly useful devices comprising current limiting polymer compositions are electrical circuit protection devices. Such circuit protection devices usually contain a current limiting polymer device comprised of two electrodes embedded in a current limiting polymer composition. When connected to a circuit, the circuit protection devices have a relatively low resistance under normal operating conditions of the circuit, but are tripped, that is, converted into a high resistance state when a fault condition, for example, excessive current or temperature, occurs. When the circuit protection device is tripped by excessive current, the current passing through the PTC device causes it to self-heat to its transition temperature or switching temperature, $T_s$, at which a rapid increase in its resistance takes place, to transform it to a high resistance state.

Representative electrical circuit protection devices and current limiting polymer compositions for use in such devices are described, for example, in U.S. Pat. Nos. 4,545,926 (Fouts, Jr., et al.); 4,647,894 (Ratell); 4,685,025 (Carlomagno); 4,724,417 (Au, et al.); 4,774,024 (Deep, et al.); 4,775,778 (van Konynenburg, et al.); 4,857,880 (Au, et al.); 4,910,389 (Sherman, et al.); 5,049,850 (Evans); and 5,195,013 (Jacobs, et al.).

In such devices a current limiting polymer composition is attached in some manner to a source of electrical power. This is generally provided by what is referred to in the art as an electrode which is in contact with the current limiting polymer composition and which is connected to a source of electrical power. The interface in these devices between the current limiting polymer composition and the electrode presents certain problems which limit the range of applications in which such devices can be reliably implemented commercially. For example, the avoidance of excessive current concentrations at any spot near the electrodes of the device presents problems, as does the provision of electrodes in a form which will reliably distribute the current over a suitable cross-sectional area of the current limiting polymer composition of the device and without variations of such distribution on repeated cycles of operation of the device. Furthermore, the use of electrodes may lead to some degree of electrical non-uniformity; if the surface of the electrode closest to the other electrode has any imperfections, this can lead to an electrical stress concentration which will cause poor performance. This problem is particularly serious when the current limiting polymer composition exhibits PTC behavior, since it can cause creation of a hot zone adjacent to the electrode; it also becomes increasingly serious as the distance between the electrodes gets smaller. Moreover, in a current limiting polymer device having a total contact resistance that exceeds 20% to 45% of the overall device resistance will, depending on the thermal transfer characteristics of the current limiting polymer composition, initially begin to undergo transition at the interface and will exhibit an increased potential for arcing across the interface. Such arcing may cause damage to the polymer composition and thereby limit the life of the device. Specifically, arcing may result in electrode delamination or a thermal/electrical break down in the electrode/polymer composition interface.

Notwithstanding, current limiting polymer compositions have found commercial application in circuit protection devices for telecommunications lines and for surge protection in small motors. Such devices, however, have been limited to use in systems with relatively low currents and voltages. These devices have been so limited due, in part, to the level of contact resistance associated with the interface between the current limiting polymer composition and the electrodes. It has been determined that the contact resistance in these devices can contribute up to 75% of the total device resistance. Accordingly, it would be desirable to have an interface between the current limiting polymer composition and the electrodes that results in a low contact resistance for the device.

The electrodes which have been used in such current limiting PTC polymer devices include solid and stranded wires, wire rovings, metal foils, expanded metal, perforated metal sheets, etc. A variety of methods have been developed for connecting the electrodes to the current limiting polymer composition. For example, U.S. Pat. Nos. 3,351,882 (Kohler, et al.); 4,272,471 (Walker); 4,426,633 (Taylor); 4,314,231 (Walty); 4,689,475 (Kleiner, et al. '475); 4,800,253 (Kleiner, et al. '253); and 4,924,074 (Fang, et al.).

Specifically, Walty describes a method for attaching planer electrodes to current limiting polymer compositions using an electrically conductive adhesive. Taylor discloses a method for laminating metal foil electrodes to the current limiting polymer composition through the use of pressure, heat and time. Taylor also discloses the optional use of an electrically conductive adhesive to help bind the electrode to the current limiting polymer composition. Finally, Kleiner, et al. '253 & '475 disclose the use of electrodes with microrough surfaces. Namely, Kleiner, et al., teaches the use of electrodes that have a roughened surface obtained by removal of material from the surface of a smooth electrode, e.g. by etching; by chemical reaction on the surface of a smooth electrode, e.g. by galvanic deposition; or by deposition of a microrough layer of the same or a different material on the surface of the electrode.

In order to obtain room temperature resistance levels in the 0.1–5 mΩ range, low bulk resistivity and low contact resistance are necessary. Current limiting polymer composition based electrical devices having a voltage rating of 500 $V_{rms}$ and a current rating of 63 $A_{rms}$ steady state for reducing let-through values in molded case circuit breakers are available. To achieve these high voltage and current ratings, however, the currently available devices require a large area parallel plate geometry with high spring pressure to connect the electrodes to the current limiting polymer composition. The high spring pressure connecting the electrodes to the current limiting polymer composition helps to reduce the contact resistance. As the pressure increases the area of real contact between the electrode and the current limiting polymer composition increases. Also the area of contact by the electrode with the conductive filler increases with increasing pressure. At these elevated pressures, the current limiting polymer composition plastically deforms to make intimate contact with the electrodes. A thin layer of polymer may cover a large percentage of the contact area between the electrodes and the current limiting polymer composition. This thin layer of polymer will prevent direct contact between the conductive filler particles in the current limiting polymer composition and the electrodes. This factor limits the decrease in device resistance obtainable through the application of pressure to connect electrodes to the current limiting polymer composition. Furthermore, the resulting device requires a large package and consequently has to be mounted externally to the circuit breaker. Therefore, it would be desirable to have a method for attaching electrodes to current limiting polymer compositions which would provide for a compact geometry and which would not require high spring pressure.

What is needed are current limiting PTC polymer devices which have a low contact resistance capable of use in high current/high voltage applications. Particularly what is needed is a method for attaching electrodes to a current limiting polymer composition and for preparing the current limiting polymer composition for such attachment which results in a low resistance electrical interface relative to the overall device resistance. A low contact resistance relative to the overall device resistance is desirable for two main reasons. First, the joule heating will occur in the bulk of the current limiting polymer composition thus inhibiting arcing at the electrode/polymer interface. Such arcing often results in electrode delamination or a thermal/electrical break down in the electrode/polymer interface. Second, the lower the overall device resistance the higher the steady state current ratings obtainable for the device.

4. SUMMARY OF THE INVENTION

We have now discovered a way to interface a porous electrode (ASTROMET, Inc. 200 Series Nickel, Copper, Stainless Steel 40 PPI) with a current limiting polymer composition such that a low contact resistance results. Specifically, it has now been discovered that porous electrodes may be interfaced with a current limiting polymer composition such that a low contact resistance results using a combination of (1) extrusion attachment of the current limiting polymer composition to the porous electrodes, (2) careful selection of the electrode materials in view of the conductive filler and/or conductive metal particles in the current limiting polymer composition, and (3) plasma treatment of the attachment surfaces of the current limiting polymer composition preceding and/or during the extrusion attachment process.

The electrical devices of the invention have the following advantageous characteristics:

- an increase in the area of contact between the conductive filler and/or conductive metal particles at the attachment surface of the polymer composition and the porous electrode attached thereto to facilitate incorporation of the electrical device into a given circuit;
- a reduction in the contact resistance of the electrical devices of the invention allowing for increased steady state current/voltage ratings;
- a reduction in required device size allowing for smaller more form fitting devices;
- no need for spring loaded systems to impart pressure at the electrode/polymer interface;
- economical device construction; and,
- increased device life facilitated by enhanced physical and chemical bonding at the electrode/polymer interface which inhibit arcing at the interface.

It is an object of the invention to provide a current limiting polymer composition with porous electrodes attached thereto in a manner that results in a low contact resistance.

It is another object of the invention to provide a current limiting polymer composition with porous electrodes attached thereto, wherein said porous electrodes may optionally be plated with different metals to enhance the chemical bonding between the porous electrode and the conductive filler dispersed within the current limiting polymer composition.

It is another object of the invention to provide a current limiting polymer composition with porous electrodes attached thereto, wherein the current limiting polymer composition is extrusion attached to the porous electrodes with a portion of the current limiting polymer composition disposed within the void space in the porous electrodes.

It is another object of the invention to provide a current limiting polymer composition with porous electrodes attached thereto, wherein the current limiting polymer composition is plasma etched to increase the conductive filler surface area at the point of extrusion attachment of the porous electrodes.

It is another object of the invention to provide a current limiting polymer composition with porous electrodes attached thereto, wherein the current limiting polymer composition is metallized at the point of extrusion attachment of the porous electrodes.

It is another object of the invention to provide an electrical device based on a current limiting polymer composition with porous electrodes attached thereto, wherein arcing at the electrode/polymer interface is inhibited.

It is another object of the invention to provide a method of attaching porous electrodes to a current limiting polymer composition wherein the current limiting polymer composition is partially extruded into the void space in the porous electrodes.

It is another object of the invention to provide a method of extrusion attaching porous electrodes to a current limiting polymer composition which incorporates plasma treatment.

One aspect of the invention resides in current limiting polymer devices which comprise: a current limiting polymer composition comprising a polymer with conductive filler dispersed therein, wherein said current limiting polymer composition has at least two conductive filler rich attachment surfaces; optionally, conductive metal particles deposited on the at least two attachment surfaces; and, at least two porous electrodes extrusion attached to said at least two attachment surfaces.

Another aspect of the invention resides in current limiting polymer devices which comprise: a current limiting polymer composition comprising a polymer with conductive filler dispersed therein, wherein said current limiting polymer composition has at least two metallized attachment surfaces; and, at least two porous electrodes extrusion attached to said at least two attachment surfaces.

Another aspect of the invention resides in a method for extrusion attaching porous electrodes to a current limiting polymer composition which comprises: heating the current limiting polymer composition; optionally, plasma etching at least two attachment surfaces on the current limiting polymer composition; optionally, depositing conductive metal particles on the at least two attachment surfaces; optionally, maintaining a vacuum in the air space surrounding the porous electrodes; and, extrusion attaching at least two porous electrodes to the at least two attachment surfaces.

5. BRIEF DESCRIPTION OF THE DRAWINGS

Figure 2:
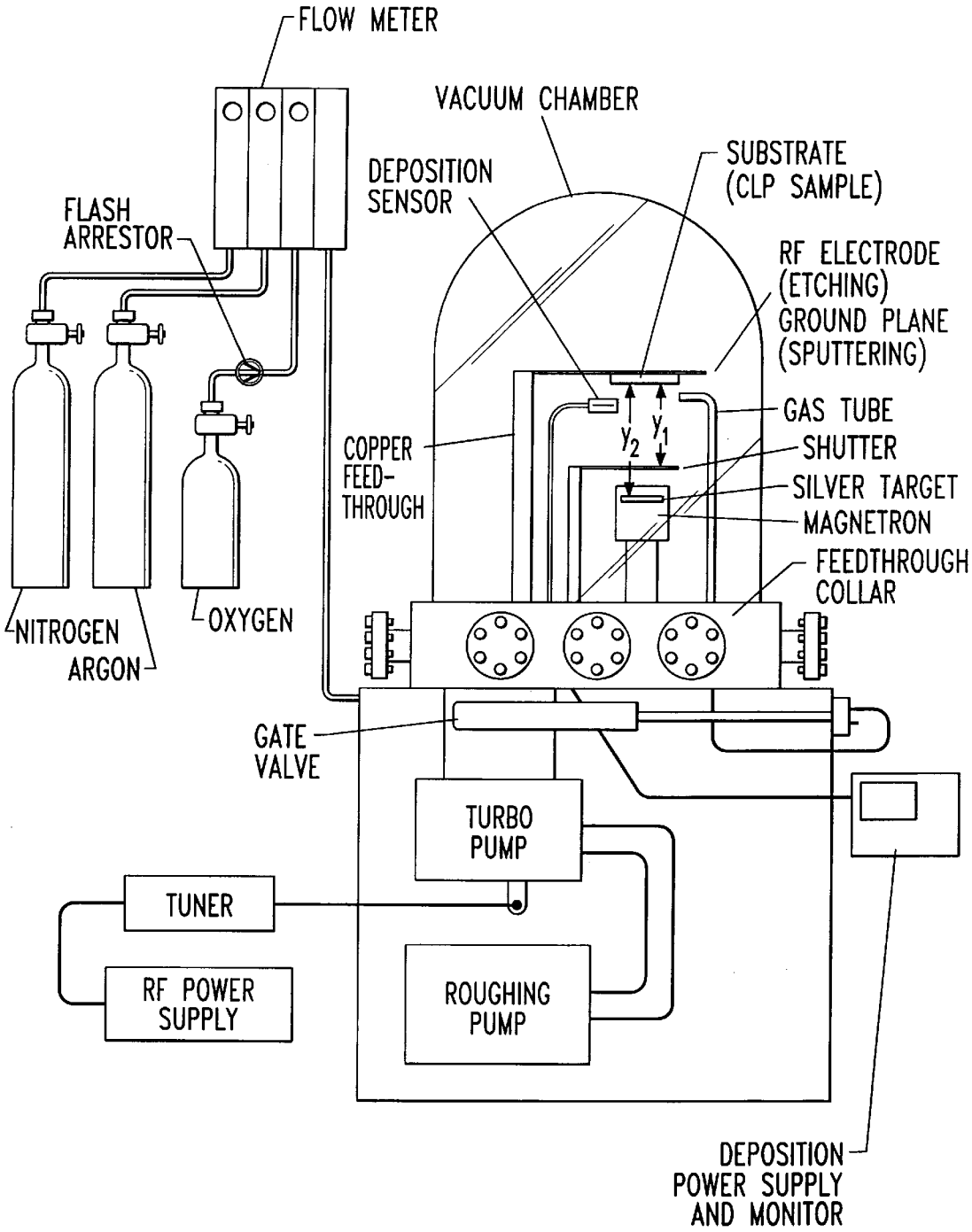

There are shown in the drawings certain exemplary embodiments of the invention as presently preferred. It should be understood that the invention is not limited to the embodiments disclosed as examples, and is capable of variation within the spirit and scope of the appended claims. In the drawings, FIG. 1 is a depiction of an apparatus suitable for use with the method of the in invention for producing current limiting PTC polymer devices with porous electrodes attached thereto; and, FIG. 2 is a depiction of an apparatus suitable for use with the method of the invention for plasma etching and/or metallizing the attachment surfaces on a current limiting polymer composition.

6. DETAILED DESCRIPTION OF THE PREFERRED EMBODIMENTS OF THE INVENTION

The following detailed description is of the best presently contemplated mode of carrying out the invention. The description is not intended in a limiting sense, and it is made solely for the purpose of illustrating the general principles of the invention. The various features and advantages of the present invention may be more readily understood with reference to the following detailed description taken in conjunction with the accompanying drawings.

The current limiting PTC polymer devices of the invention are characterized by having a low contact resistance, mechanical stability and a reduced potential for arcing in the electrode/polymer interface. One aspect of the invention provides an electrical device which comprises: a current limiting polymer composition comprising a polymer with conductive filler dispersed therein, wherein said current limiting polymer composition has at least two attachment surfaces; optionally, the at least two attachment surfaces can be plasma etched to provide at least two conductive particle rich attachment surfaces; optionally, the at least two attachment surfaces can be metallized to provide at least two metallized attachment surfaces; and, at least two porous electrodes extrusion attached to the current limiting polymer composition at the at least two attachment surfaces. Such devices are characterized by being relatively conductive when used as a circuit component carrying normal current but which exhibit a very sharp increase in resistivity and reversibly transform into being relatively non-conductive when the temperature of the device increases above a switching temperature or switching temperature range, $T_s$, due to resistive Joule heating ($I^2R$) generated from a fault current. The electrical devices of the invention are particularly useful as PTC elements in electrical circuit protection devices.

The polymers suitable for use in preparing the current limiting polymer compositions of the invention can be thermoplastic, elastomeric or thermosetting resins or blends thereof; preferably thermoplastic polymers; most preferably polyethylene polymers.

Thermoplastic polymers suitable for use in the invention, may be crystalline or non-crystalline. Illustrative examples are polyolefins, such as polyethylene or polypropylene, copolymers (including terpolymers, etc.) of olefins such as ethylene and propylene, with each other and with other monomers such as vinyl esters, acids or esters of α, β-unsaturated organic acids or mixtures thereof, halogenated vinyl or vinylidene polymers such as polyvinyl chloride, polyvinylidene chloride, polyvinyl fluoride, polyvinylidene fluoride and copolymers of these monomers with each other or with other unsaturated monomers, polyesters, such as poly(hexamethylene adipate or sebacate), poly(ethylene terephthalate) and poly(tetramethylene terephthalate), polyamides such as Nylon-6, Nylon-6,6 Nylon-6,10 and the "Versamids" (condensation products of dimerized and trimerized unsaturated fatty acids, in particular linoleic acid with polyamines), polystyrene, polyacrylonitrile, thermoplastic silicone resins, thermoplastic polyethers, thermoplastic modified celluloses, polysulphones and the like.

Suitable elastomeric resins include rubbers, elastomeric gums and thermoplastic elastomers. The term "elastomeric gum", refers to a polymer which is non-crystalline and which exhibits rubbery or elastomeric characteristics after being cross-linked. The term "thermoplastic elastomer" refers to a material which exhibits, in a certain temperature range, at least some elastomer properties; such materials generally contain thermoplastic and elastomeric moieties.

Suitable elastomeric gums for use in the invention include, for example, polyisoprene (both natural and synthetic), ethylene-propylene random copolymers, poly (isobutylene), styrene-butadiene random copolymer rubbers, styreneacrylonitrile-butadiene random copolymer rubbers, styreneacrylonitrile-butadiene terpolymer rubbers with and without added minor copolymerized amounts of α, β-unsaturated carboxylic acids, polyacrylate rubbers, polyurethane gums, random copolymers of vinylidene fluoride and, for example, hexafluoropropylene, polychloroprene, chlorinated polyethylene, chlorosulphonated polyethylene, polyethers, plasticized poly(vinyl chloride) containing more than 21% pasticizer, substantially non-crystalline random co- or ter-polymers of ethylene with vinyl esters or acids and esters of α, β-unsaturated acids. Silicone gums and base polymers, for example poly(dimethyl siloxane), poly(-methylphenyl siloxane) and poly(dimethyl vinyl siloxanes) can also be use.

Thermoplastic elastomers suitable for use in the invention, include graft and block copolymers, such as random copolymers of ethylene and propylene grafted with polyethylene or polypropylene side chains, and block copolymers of α-olefins such as polyethylene or polypropylene with ethylene/propylene or ethylene-propylene/diene rubbers, polystyrene with polybutadiene, polystyrene with polyisoprene, polystyrene with ethylene-propylene rubber, poly(vinylcyclohexane) with ethylene-propylene rubber, poly(α-methylstyrene) with polysiloxanes, polycarbonates with polysiloxanes, poly(tetramethylene terephthalate) with poly(tetramethylene oxide) and thermoplastic polyurethane rubbers.

Thermosetting resins, particularly those which are liquid at room temperature and thus easily mixed with the conductive filler can also be used. Conductive compositions of thermosetting resins which are solids at room temperature can be readily prepared using solution techniques. Typical thermosetting resins include epoxy resins, such as resins made from epichchlorohydrin and bisphenol A or epichlorohydrin and aliphatic polyols, such as glycerol. Such resins are generally cured using amine or amide curing agents. Other thermosetting resins such as phenolic resins obtained by condensing a phenol with an aldehyde, e.g. phenol-formaldehyde resin, can also be used.

Conductive filler suitable for use in the invention can include, for example, conductive carbon black, graphite, carbon fibers, metal powders, e.g., nickel, tungsten, silver, iron, copper, etc., or alloy powders, e.g., nichrome, brass, conductive metal salts, and conductive metal oxides; with carbon black, graphite and carbon fibers being preferred; carbon black being most preferred. The conductive particles are distributed or dispersed in the polymer, to form conductive chains in the polymer under normal temperature conditions. The conductive filler is dispersed in the polymer preferably in the amount of 5 to 80% by weight, more preferably 10 to 60% by weight, and more preferably about 30 to 55% by weight, based on the weight of the total polymer. The conductive filler preferably has a particle size from about 0.01 to 200 microns, preferably from about 0.02 to 25 microns. The conductive filler can be of any shape, such as flakes, rods, spheroids, etc., preferably spheroids. The amount of conductive filler incorporated into the polymer matrix will depend on the desired resistivity of the current limiting PTC polymer device. In general, greater amounts of conductive filler in the polymer will result in a lower resistivity for a particular polymeric material.

The current limiting polymer compositions of the invention can further comprise non-conductive fillers including arc suppression agents, e.g., alumina trihydrate, radiation cross-linking agents, antioxidants, flame retardants, inorganic fillers, e.g. silica, plasticizers, and other adjuvants.

The current limiting polymer compositions of the invention are preferably cured by cross-linking to impart the desired resistance-temperature characteristics to the current limiting PTC polymer device. The current limiting polymer compositions of the invention can be cross-linked by radiation or by chemical cross-linking. For a description of radiation and/or chemical cross-linking methods known in the art, see, for example, U.S. Pat. Nos. 5,195,013 (Jacobs et al.); 4,907,340 (Fang et al.); 4,485,838 (Jacobs et al.); 4,775,778 (van Konynenburg et al.); and, 4,724,417 (Au et al.); the disclosures of which are incorporated herein by reference. Regardless of the cross-linking method used, however, the cross-links formed should be stable for operation in the temperature range in which the current limiting PTC polymer device is required to operate and also provide the element with the desired characteristics.

Before interfacing with the porous electrodes, the current limiting polymer compositions of the invention may be prepared by conventional plastic processing techniques such as melt blending the polymer component and the conductive filler component, and optional adjuvants and then molding, e.g., injection or blow molding, or extruding the uncross-linked polymer, and then cross-linking the polymer. Note that the current limiting polymer compositions of the invention may be cross-linked subsequent to the extrusion attachment of the porous electrodes.

Optionally, the current limiting polymer compositions of the invention may be plasma etched to form at least two conductive filler rich attachment surfaces. The conductive filler rich attachment surfaces have a higher concentration of conductive filler exposed (i.e., no polymer film covering the surface of the filler on the treated surface of the current limiting polymer composition) than do the untreated surfaces of the current limiting polymer composition. Because the conductive filler is more conductive than the polymer, an increase in concentration of conductive filler on the attachment surfaces of the current limiting polymer composition will result in a decrease in the contact resistance between said attachment surface and the porous electrode subsequently attached thereto. Specifically, generally speaking, the greater the area of real contact between the conductive filler and the porous electrode, the lower the contact resistance. Plasma etching the attachment surfaces of the current limiting polymer composition provides an increase in the area of real contact between the current limiting polymer composition and the porous electrodes, thus reducing the contact resistance.

Optionally, the current limiting polymer compositions of the invention may be metallized to form metallized attachment surfaces. The current limiting polymer compositions of the invention may be metallized by depositing conductive metal particles on the attachment surfaces. The conductive metal particles may be deposited on the attachment surfaces subsequent to plasma etching thereof. Alternatively, the conductive metal particles may be deposited on non-plasma etched attachment surfaces. The conductive metal particles deposited on the attachment surfaces should be carefully selected to enhance the interface between the porous electrodes and the current limiting polymer composition so as to reduce the contact resistance and to inhibit arcing in the interface. For example, when the conductive filler dispersed within the current limiting polymer composition comprises carbon black, the metals used to metallize the current limiting polymer composition should be capable of reacting with the carbon black to form a carbide; preferably the metal should be selected from the group comprising tantalum, tungsten, titanium, chromium molybdenum, vanadium, zirconium, aluminum, silver, nickel and mixtures thereof; more preferably from a group of metals which exhibit both a low oxidation and the tendency to form highly conductive oxides, i.e., Ti, Cr or some form of hybrid which reacts to form a highly conductive oxide, i.e., $WTiC_2$. Alternatively, non-carbide forming metals may be used provided that they maintain long term (≧10 year) conductivity, i.e. silver, nickel, silver plating over copper, and silver plating over nickel, may be used with the invention.

Porous electrodes suitable for use with the invention include porous metal electrodes. Preferably, the porous electrodes have 40 pores/inch. Also, porous metal electrodes suitable for use with the invention are preferably made of nickel, stainless steel or copper. Copper has the benefit of being receptive to plating with various metals, especially silver.

The porous electrodes may optionally be plated with a metal using conventional plating methods such as electroplating or ultrasonically to insure uniform plating throughout the interior. The purpose of plating the base electrode with a metal is to facilitate enhanced chemical bonding between the electrode and the conductive filler in the current limiting polymer composition. The plating material and underlying base electrode material should be selected on the basis of obtaining a low contact resistance and oxidation stability. For example, if the conductive filler is carbon, the plating will preferably be of a metal which forms conductive carbides. Metals suitable for use as a plating material include titanium, tungsten, vanadium, molybdenum, chromium, zirconium, tantalum, cobalt, silver, copper, nickel, aluminum, gold, brass, zinc and mixtures thereof.

Another aspect of the invention provides a method for attaching porous electrodes to current limiting polymer compositions. Said method incorporates the use of plasma treatment techniques to enhance the physical/chemical bond between the conductive filler in the current limiting polymer composition and the porous electrodes. Specifically, the method for attaching porous electrodes to a current limiting polymer composition comprises: heating the current limiting polymer composition; optionally, plasma etching at least two attachment surfaces on the current limiting polymer composition; optionally, depositing conductive metal particles on the at least two attachment surfaces; optionally, maintaining a vacuum in the air space surrounding the porous electrodes; and, extrusion attaching at least two porous electrodes to the at least two attachment surfaces.

Under the method of the invention, the current limiting polymer composition is preferably heated to a temperature of from about 150° C. to about 220° C.

Optionally, the attachment surfaces on the current limiting polymer composition intended to receive porous electrodes may be plasma treated to increase the surface area of exposed conductive filler. Specifically, the attachment surfaces may optionally be plasma etched using well known plasma etching techniques. Of the various known plasma etching techniques, corona etching may be particularly useful with the invention. Corona etching in air at atmospheric pressure may be as effective as etching at reduced pressures while being more cost effective and easier to implement on a manufacturing scale compared to more conventional plasma etching processes.

For the purposes of this invention, plasma etching involves the selective removal of polymer molecules from the treated surfaces of the current limiting polymer composition using plasma processing. Basically, plasma etching entails ion bombardment as well as chemical reactions of the surface of the current limiting polymer composition with mobile ions. Because the polymer molecules are more readily energized by the ion bombardment, the plasma etching results in a greater loss of polymer molecules from the surface of the current limiting polymer composition compared to the loss of atoms or molecules of the conductive filler. Accordingly, the plasma etched surface of the current limiting polymer composition has a higher concentration of conductive filler exposed (i.e., no polymer film covering the surface of the filler on the treated surface of the current limiting polymer composition) than do the untreated surfaces. Hence, selective treatment of a surface of the current limiting polymer composition leaves said surface enriched with conductive filler, i.e., carbon black. Because the conductive filler is more conductive than the polymer, the increase in the concentration of conductive filler at the surface of the current limiting polymer composition results in a significant decrease in the contact resistance between said treated surface and the porous electrode subsequently attached thereto.

The attachment surfaces may optionally be metallized. The surface of the current limiting polymer composition can be metallized using a deposition process known in the art as plasma sputtering. Alternatively, plasma spray techniques in air at atmospheric pressure may be used to metallize the surfaces of conductive polymer compositions on a manufacturing scale at reduced cost compared to conventional plasma sputtering processes. Basically, the plasma sputtering process entails bombarding a metal target, i.e., silver, with argon ions, or similar ions such that metal atoms are liberated from the surface of the target and impinge on the surface of the current limiting polymer composition. Before being metallized, the selected surfaces of the current limiting polymer composition can be optionally plasma etched. In the event that the selected surfaces are plasma etched prior to metallization, it is preferable that the plasma etching and plasma sputtering processes be performed in the same apparatus. It is most preferable that the interior cavity of the apparatus not be exposed to atmospheric gases between the etching and sputtering processes. Such procedure is preferred because atmospheric gases may contaminate the sample surface.

The extrusion attachment is effected by forcing the porous electrodes and the current limiting polymer composition together such that the current limiting polymer composition extrudes into the void space in the porous electrodes. The force used to press the porous electrodes and the current limiting polymer together preferably ranges from between 10 lbs. and 500 lbs.

Optionally, a vacuum may be applied and maintained in the air space surrounding the porous electrodes during the extrusion attachment procedure. The purpose of applying and maintaining the vacuum is to aid the extrusion of current limiting polymer composition into the void space in the porous electrodes. Preferably, the vacuum applied and maintained should be at least about 10 mTorr to 200 mTorr.

The porous electrodes may optionally be extrusion attached to the current limiting polymer material in the same apparatus used to plasma etch the attachment surfaces. Particularly, FIG. 1 is a depiction of an apparatus suitable for use with the method for extrusion attaching porous electrodes to a current limiting polymer composition while simultaneously plasma treating the attachment surfaces. An electric field can be applied between the current limiting polymer composition and the porous electrodes and the appropriate plasma gases may be fed into the interstice between the attachment surface and the porous electrode prior to the extrusion attachment. For plasma sputtering, the porous electrode may be used as the target or a sacrificial target may be introduced into the system. When both the plasma treatment and extrusion attachment are performed in the same apparatus, the rate at which the current limiting polymer composition is extruded into the voids in the porous electrodes is important. If the rate is too fast, the surface of the current limiting polymer composition will not be sufficiently etched by the plasma and/or sufficiently metallized. Preferably, the rate is slow enough to allow a minimum of 120 seconds of plasma etching and/or metallization time before the porous electrode comes into physical contact with the current limiting polymer composition.

Alternatively, the current limiting polymer composition may first be plasma etched and/or metallized in one apparatus. For example, FIG. 2 is a depiction of an apparatus suitable for use with the method of the invention for plasma etching and/or metallizing the attachment surfaces on a current limiting polymer composition. The plasma etched and/or metallized current limiting polymer composition may then be transferred to another apparatus for the extrusion attachment of porous electrodes.

By extruding the current limiting polymer composition into the void space in the porous electrodes, the effective surface area between the current limiting polymer composition and the porous electrodes is significantly larger than for a comparably sized flat plate electrode. Additionally, the void space in the porous electrodes filled with current limiting polymer composition provide a mechanically stable connection which is resistant to delamination and arcing in the interface.

The current limiting PTC polymer devices of the invention are typically connected in series with a power source and load. The source voltage can be rated as high as 600 $V_{rms}$. Preferred devices of the invention are reliable at rated voltages of 120 $V_{rms}$ to 600 $V_{rms}$ and have a survival life of at least three high fault short circuits (i.e., 480 V/100 kA) when used as a series fault current protection device in devices such as molded case circuit breakers, miniature circuit breakers and contactors.

The current limiting PTC polymer devices of the invention can also be used for protecting motors, solenoids, telephone lines and batteries. These devices also can be used like fuses or circuit breakers but have the advantage of not requiring replacement or manual reset after a fault condition, since they are automatically resettable.

While certain present preferred embodiments of the invention have been illustrated and described, it is to be understood that the invention is not limited thereto and may be otherwise practiced within the scope of the following claims.

I claim:

1. A current limiting polymer device comprising:

a current limiting polymer composition comprising a polymer with conductive filler dispersed therein, wherein said current limiting polymer composition has at least two conductive filler rich attachment surfaces having exposed conductive filler; and, at least two solid porous electrodes extrusion attached directly to said at least two attachment surfaces wherein the polymer composition extrudes into the void space in the porous electrodes.

2. The device of claim 1, wherein said at least two attachment surfaces having exposed conductive filler are formed by plasma etching the surface of the current limiting polymer composition, and the electrodes have about 40 pores/inch, where the area of real contact between the exposed conductive filler and the electrode is effective to provide lower contact resistance.

3. The device of claim 1, wherein said at least two attachment surfaces further comprise conductive metal particles deposited thereon.

4. The device of claim 3, wherein the conductive metal particles are selected from the group comprising tantalum, tungsten, titanium, chromium, molybdenum, vanadium, zirconium, aluminum, silver, nickel and mixtures thereof.

5. The device of claim 3, wherein said conductive metal particles consist of a mixture of titanium and chromium.

6. The device of claim 3, wherein said conductive metal particles consist of a mixture of titanium and tungsten.

7. The device of claim 1, wherein said at least two porous electrodes are porous metal electrodes.

8. The device of claim 7, wherein the porous metal electrodes are made of a metal selected from the group of metals comprising nickel, stainless steel and copper.

9. The device of claim 7, wherein the porous electrodes are plated with a metal.

10. The device of claim 9, wherein the porous electrodes are plated with a metal selected from the group comprising titanium, tungsten, vanadium, molybdenum, chromium, zirconium, tantalum, cobalt, silver, copper, nickel, aluminum, gold, brass, zinc and mixtures thereof.

11. A current limiting polymer device comprising:

a current limiting polymer composition comprising a polymer with conductive filler dispersed therein, wherein said current limiting polymer composition has at least two metallized attachment surfaces; and, at least two solid porous electrodes extrusion attached directly to said at least two attachment surfaces, wherein the polymer composition extrudes into the void space in the porous electrodes.

12. The device of claim 11, wherein said at least two porous electrodes are porous metal electrodes, the electrodes have about 40 pores/inch, and where the area of real contact between the exposed conductive filler and the electrode is effective to provide lower contact resistance.

13. The device of claim 12, wherein the porous metal electrodes are made of a metal selected from the group of metals comprising nickel, stainless steel and copper.

14. The device of claim 11, wherein the porous electrodes are plated with a metal.

15. The device of claim 14, wherein the porous electrodes are plated with a metal selected from the group comprising titanium, tungsten, vanadium, molybdenum, chromium, zirconium, tantalum, cobalt, silver, copper, nickel, aluminum, gold, brass, zinc and mixtures thereof.

16. The device of claim 11, wherein said at least two attachment surfaces are metallized by plasma sputtering conductive metal particles thereon, wherein said conductive metal particles are selected from the group comprising tantalum, tungsten, titanium, chromium, molybdenum, vanadium, zirconium, aluminum, silver, nickel and mixtures thereof.

17. The device of claim 16, wherein said conductive metal particles consist of at least one of titanium and chromium.

18. The device of claim 16, wherein said conductive metal particles comprise a mixture of tungsten and titanium.

19. A method for making a current limiting polymer device comprising:

(a) heating a conductive polymer composition with conductive filler dispersed therein;

(b) plasma etching at least two attachment surfaces on the current limiting polymer composition to expose conductive filler; and, (c) directly extrusion attaching at least two porous electrodes to the at least two attachment surfaces so that the polymer composition extrudes into the void space in the porous electrodes.

20. The method of claim 19, wherein the current limiting polymer composition is heated to a temperature from 150° C. to 220° C.

21. The method of claim 19, wherein the at least two porous electrodes are extrusion attached to the current limiting polymer composition by forcing together the porous electrodes and the current limiting polymer composition.

22. The method of claim 19, further comprising:

(b1) maintaining a vacuum in the air space surrounding the at least two porous electrodes.

23. The method of claim 22, wherein the vacuum maintained is at least 200 mTorr.

24. The method of claim 19, further comprising:

(b2) depositing conductive metal particles on the at least two attachment surfaces.

25. The method of claim 24, wherein the conductive metal particles are selected from the group comprising tantalum, tungsten, titanium, chromium, molybdenum, vanadium, zirconium, aluminum, silver, nickel and mixtures thereof.

26. The method of claim 24, wherein the conductive metal particles consist of at least one of titanium and chromium.

27. The method of claim 24, wherein the conductive metal particles consist of a mixture of titanium and tungsten.

28. A method for making a current limiting polymer device comprising:

(a) heating a conductive polymer composition with conductive filler dispersed therein;

(b) metallizing at least two attachment surfaces on the current limiting polymer composition; and, (c) directly extrusion attaching at least two porous electrodes to the at least two attachment surfaces so that the polymer composition extrudes into the void space in the porous electrodes.

29. The method of claim 28, wherein the current limiting polymer composition is heated to from 150° C. to 220°.

30. The method of claim 28, wherein the at least two porous electrodes are extrusion attached to the current limiting polymer composition by forcing together the porous electrodes and the current limiting polymer composition.

31. The method of claim 28, further comprising:

(b1) maintaining a vacuum in the air space surrounding the at least two porous electrodes.

32. The method of claim 31, wherein the vacuum maintained is at least 200 mTorr.

* * * * *